US008038727B2

(12) United States Patent
Chardon et al.

(10) Patent No.: US 8,038,727 B2
(45) Date of Patent: Oct. 18, 2011

(54) TREATING TEXTILE MATERIALS WITH POLYORGANOSILOXANES

(75) Inventors: Josette Chardon, Lyons (FR); Philippe Olier, Lyons (FR)

(73) Assignee: Bluestar Silicones France, Lyon Cedex (FR)

( * ) Notice: Subject to any disclaimer, the term of this patent is extended or adjusted under 35 U.S.C. 154(b) by 0 days.

(21) Appl. No.: 11/892,552

(22) Filed: Aug. 23, 2007

(65) Prior Publication Data

US 2008/0052839 A1 Mar. 6, 2008

(51) Int. Cl.
*D06M 15/643* (2006.01)

(52) U.S. Cl. ..... 8/115.6; 252/8.63

(58) Field of Classification Search ..... 252/8.63; 8/115.6

See application file for complete search history.

(56) References Cited

U.S. PATENT DOCUMENTS

| | | | | |
|---|---|---|---|---|
| 5,238,731 | A * | 8/1993 | Blanch et al. | 442/99 |
| 5,767,206 | A * | 6/1998 | Ariagno et al. | 525/479 |
| 6,184,406 | B1 * | 2/2001 | Geck et al. | 556/401 |
| 6,265,496 | B1 * | 7/2001 | Priou et al. | 525/477 |

FOREIGN PATENT DOCUMENTS

| | | | |
|---|---|---|---|
| WO | 98/28375 | * | 7/1998 |
| WO | WO99/02581 | * | 1/1999 |

* cited by examiner

*Primary Examiner* — Amina Khan
(74) *Attorney, Agent, or Firm* — Buchanan Ingersoll & Rooney, P.C.

(57) ABSTRACT

The invention concerns a method for treating textile materials providing said textile materials with a soft feel, absence of yellowing and good hydrophily, which consists of contacting the textile materials with a composition comprising at least a linear, cyclic or three-dimensional polyorganosiloxane of formula (I), wherein: the symbols Z, identical or different, represent R1, and/or V; and the symbols V represent a group of sterically hindered piperidinyl function(s).

11 Claims, No Drawings

TREATING TEXTILE MATERIALS WITH POLYORGANOSILOXANES

The present invention relates to a method for treating textile materials providing the textile fiber with good hydrophilicity, absence of yellowing and a soft feel to the touch, that is to say properties of softness.

Various approaches are described in the prior art for obtaining textile softening treatments.

The document U.S. Pat. No. 4,409,267 describes, for example, the use of a mixed polyorganosiloxane carrying, on the one hand, a primary or secondary amine functional group or groups substituted, for example, with residues containing an OH or O-alkyl group, and, on the other hand, a polyalkylene oxide functional group or groups as additive for a composition for treating textile materials. The document EP-546 231 describes another approach via the use of a polyorganosiloxane carrying a unit or units of formula $Si—(CH_2)_y—(OCH_2)_{y'}—CH(OH)CH_2—N(CH_2CH_2OH)_2$ where y' is between 2 and 8 and y' is equal to 0 or 1.

The applicant has also proposed solutions described in particular in EP 659 930 and FR 2,745,825.

EP 659 930 describes silicone-based textile softeners comprising from 2 to 1 600 silicon atoms, carrying one to one hundred sterically hindered amino units and optionally other units such as, for example, alkyl radicals having from 5 to 20 carbon atoms or radicals $—(CH_2)_p—COOR—R$.

FR 2,745,825 describes silicone-based textile softeners carrying at least one sterically hindered amino unit and at least one polyether type radical of formula $(CH_2)_n—(OCH_2CH_2)_\alpha(OCH_2CHCH_3)_\beta—OR$.

These approaches have led to the preparation of silicones in which the softening properties are provided to the textile in particular by the presence of amino functional groups, and the hydrophilic properties are provided in particular by the presence of polar functional groups such as polyether-type functional groups, the latter partially compensating for the loss of hydrophilicity of the material treated with silicone. It should be noted, in addition, that the preparation of these products uses routes of syntheses which are relatively complex and which are therefore scarcely economically viable.

Now, the applicant has found, unexpectedly, that silicone compounds have remarkable advantages compared with the other compounds known in the prior art.

Indeed, the applicant has developed a novel method for treating textile using softening, hydrophilic and nonyellowing silicone oils carrying sterically hindered amino functional groups. This innovative approach consists in providing the textile material with the softness and the absence of yellowing by treatment with a silicone oil carrying a hindered amino functional group, without masking the intrinsic hydrophilicity of the textile material treated.

Another advantage of the method of treating textile according to the present invention comes from the fact that it can be carried out with a polyorganosiloxane which is easy to prepare industrially and which is stable during storage.

Another advantage of the method for treating textile according to the present invention comes from the easy treatment of the composition containing the polyorganosiloxane according to the invention for its application to the materials to be treated.

There has therefore now been found, and that is what constitutes the subject of the present invention, a method for treating textile materials in order to provide them with a soft feel, absence of yellowing and good hydrophilicity, in which the textile materials are brought into contact with a composition comprising at least one linear, cyclic or three-dimensional polyorganosiloxane of formula (I):

(I)

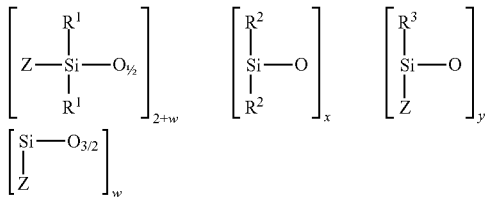

in which:

(1) the symbols Z, which are identical or different, represent $R^1$, and/or V;

(2) the symbols $R^1$, $R^2$ and $R^3$, which are identical or different, represent a monovalent hydrocarbon radical chosen from linear or branched alkyl radicals having from 1 to 4 carbon atoms, linear or branched alkoxy radicals having from 1 to 4 carbon atoms, a phenyl radical and, preferably, a hydroxyl radical, an ethoxy radical, a methoxy radical or a methyl radical;

(3) the symbols V, functional groups which are identical or different, represent a group containing a sterically hindered piperidinyl functional group or groups chosen from:

(II)

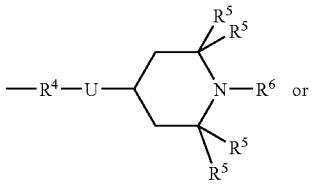

(III)

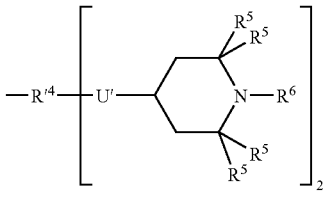

For the groups of formula (II):

(II)

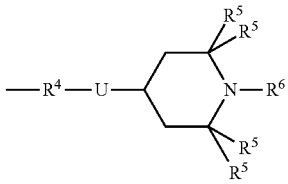

$R^4$ is a divalent hydrocarbon radical chosen from:

linear or branched alkylene radicals having 2 to 18 carbon atoms;

alkylene-carbonyl radicals in which the linear or branched alkylene portion contains 2 to 20 carbon atoms;

alkylene-cyclohexylene radicals in which the linear or branched alkylene portion contains 2 to 12 carbon atoms and the cyclohexylene portion contains an OH group and optionally 1 or 2 alkyl radicals having 1 to 4 carbon atoms;

radicals of formula $—R^7—O—R^7$ in which the radicals $R^7$, which are identical or different, represent alkylene radicals having 1 to 12 carbon atoms;

radicals of formula —$R^7$—O—$R^7$ in which the radicals $R^7$ have the meanings indicated above and one of them or both of them are substituted by one or two —OH group or groups;

radicals of formula —$R^7$—COO—$R^7$ in which the radicals $R^7$ have the meanings indicated above;

radicals of formula —$R^8$—O—$R^9$—O—CO—$R^8$ in which the radicals $R^8$ and $R^9$, which are identical or different, represent alkylene radicals having 2 to 12 carbon atoms and the radical $R^9$ is optionally substituted by a hydroxyl radical;

U represents —O— or —$NR^{10}$—, $R^{10}$ being a radical chosen from a hydrogen atom, a linear or branched alkyl radical containing 1 to 6 carbon atoms and a divalent radical of formula:

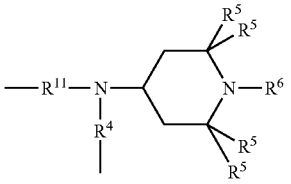

in which $R^4$ has the meaning indicated above, $R^5$ and $R^6$ have the meanings indicated below and $R^{11}$ represents a linear or branched divalent alkylene radical having from 1 to 12 carbon atoms, one of the valency bonds (that of $R^{11}$) being linked to the atom of —$NR^{10}$—, the other (that of $R^4$) being linked to a silicon atom;

the radicals $R^5$, which are identical or different, are chosen from linear or branched alkyl radicals having 1 to 3 carbon atoms and the phenyl radical;

the radical $R^6$ represents a hydrogen radical or the radical $R^5$ or O..

For the groups of formula (III):

(III)

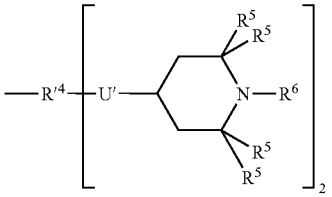

$R'^4$ is chosen from a trivalent radical of formula:

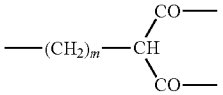

where m represents a number from 2 to 20, and a trivalent radical of formula:

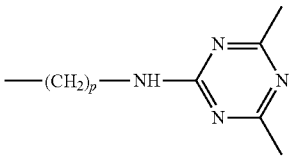

where p represents a number from 2 to 20;

U' represents —O— or $NR^{12}$—, with $R^{12}$ being a radical chosen from a hydrogen atom, a linear or branched alkyl radical containing 1 to 6 carbon atoms;

$R^5$ and $R^6$ have the same meanings as those given with respect to the formula (II); and (4)

the number of units ηSi with no group V is between 10 and 450, the number of units ηSi with a group V is between 1 and 5

$0 \leqq w \leqq 10$ and $8 \leqq y \leqq 448$

Advantageously, at least one of the silicone oils selected for the textile treatment is such that the number of units ηSi with no group V is between 50 and 250, and the number of units ηSi with a group V is between 1 and 3.

The silicone oil used in the context of the invention in particular does not require the presence of other functional groups to provide the treated textile material with hydrophilic properties. However, if it is desired to obtain a hydrophilicity greater than that intrinsic to material before treatment, the silicone oil used may contain other functional groups which promote this property.

According to a preferred embodiment of the method of the invention, the polyorganosiloxane of formula (I) used is linear.

According to another preferred embodiment, the functional group V of the polyorganosiloxane of formula (I) used is chosen from the functional groups of formula (II).

Regardless of the constitution chosen for the composition containing the polyorganosiloxane, the method of treatment may be carried out on materials of the woven, nonwoven or knitted form. The fibers of these materials are at least partially hydrophilic, and this hydrophilicity is preserved after treatment with silicone according to the invention regardless of the hydrophobic nature of its backbone.

The materials, which are at least partially hydrophilic, may in particular consist of or be based on cotton, flax, wool, viscose, rayon, hemp, silk or a mixture of these materials. These materials may be optionally mixed with other materials which are scarcely or not hydrophilic, such as polyester (for example a cotton-polyester mixture), keratin, polypropylene, polyethylene, polyurethane, polyamide or cellulose acetate.

The composition containing the polyorganosiloxane may be prepared in numerous forms: liquid, gaseous or solid. In the case of a liquid preparation of the composition, it will be advantageously aqueous, either in the form of a solution, dispersion or emulsion.

Preferably, the composition is prepared in the form of an aqueous emulsion. However, the composition according to the method of the invention may also be used in solution in an organic solvent.

The aqueous emulsions are generally based on a mixture of oil and water, and are prepared according to conventional methods well known to persons skilled in the art, using surfactants. For example, the emulsions may be prepared by so-called direct methods or by inversion. Their implementation is easy and does not require the use of equipment having a high stirring rate. Equipment with a normal stirring rate may be used.

In general, the aqueous emulsions prepared in accordance with the invention preferably contain between 20 and 90% by weight of water relative to the total mass of the constituents of the emulsion. For a better application, the emulsions prepared in accordance with the invention are preferably diluted so as to contain between 95 and 99.5% by weight of water, relative to the total weight of the emulsion. These emulsions are found to be stable at room temperature.

The application of the polyorganosiloxane according to the invention to the materials to be treated may be carried out in a wide variety of forms. The applications may be carried out by immersion, coating, spraying, impression, padding or by any other existing means.

For example, when the fabric is treated with an aqueous composition containing a polyorganosiloxane according to the invention, said fabric is subjected to a heat treatment in order to rapidly expel the water in vapor form.

The quantity of polyorganosiloxane deposited on the material to be treated varies according to the make-up and the manufacture of said material. Applications of the compositions and in particular of aqueous emulsions to the treated materials are carried out such that the increase in weight of the treated material does not exceed 0.1 to 20% by weight relative to the weight of the material before treatment. In general, the best results were obtained with a quantity of polyorganosiloxane of between 0.1 and 2% by weight relative to the weight of the material to be treated.

The polyorganosiloxanes defined above may be prepared according to various methods, for example: distribution or hydrosilylation.

EXAMPLES

The examples below illustrate the properties of the silicone oils according to the invention.

The oils are tested by applying in the form of an aqueous emulsion and the measurements of hydrophilicity, nonyellowing and evaluation of feel are carried out according to the tests described below.

Measurement of Nonyellowing (Whiteness Value)

The evaluation of the yellowing is carried out by measuring the color of the cloth (white cotton toweling at the beginning) after impregnation with silicone oil and heat treatment of 9 minutes at 150° C.

The measurement of color is carried out on an ACS Sensor II spectrophotocolorimeter marketed by the company Datacolor. The conditions of measurement are the use of the D65 illuminant, which reproduces daylight. Using the measurement of the color of the cloth sample, the apparatus calculates the values of various whiteness and yellowing values, among which we shall use the CIE whiteness value.

Test of Feel

After applying oil, the cotton toweling is dried in ambient air for 24 hours. After a heat treatment of 1 minute 30 seconds at 150° C., the cloth is placed for 24 hours for conditioning (23±2° C., 50±5% relative humidity).

The softness is evaluated by a group of testers who are asked to classify the roughest cloth samples (minimum score=1) and the softest cloth samples (maximum score=total number of samples).

Measurement of Hydrophilicity

After applying oil, the polyester-cotton cloth (50/50) undergoes a heat treatment of 5 minutes at 170° C., It is then conditioned for 24 hours (23±2° C., 60±5% relative humidity).

The measurements of hydrophilicity are given by the TEGEWA test in which the time for absorbing a drop of water deposited at the surface of the cloth is measured. The shorter the time, the more hydrophilic the cloth.

Preparation of the Emulsions

The silicone oils of the emulsions tested E1 to E7 have the structure:

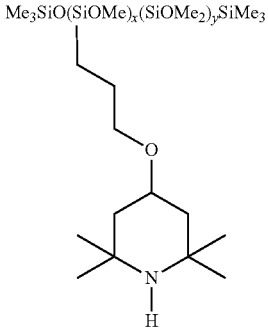

The number of D units and amino units of the oils used is specified in table I.

The emulsions are prepared using a method of emulsification by inversion, and have the following composition: 20 g of silicone oil tested, 8 g of surfactant ($C_{13}E_6$ fatty alcohol), a quantity of glacial acetic acid which is stoichiometrically necessary for neutralizing the amine and the balance for 100 g with water.

TABLE I

| Emulsion | y | x |
|---|---|---|
| Examples | | |
| E1 | 100 | 0.5 |
| E2 | 100 | 1 |
| E3 | 100 | 2 |
| E4 | 100 | 4 |
| E5 | 250 | 2.5 |
| Counter-examples | | |
| E6 | 350 | 9 |
| E7 | 450 | 16.5 |

The evaluations were made on textiles treated with 0.6% by weight of silicone oil. The emulsions are applied to the cloth by padding.

The properties of the cloths treated with the various emulsions E1 to E7 were evaluated and compared with each other per series. The results obtained for each series are not absolute values but relative values which are comparable within the same series.

| First series | |
|---|---|
| Emulsion | Nonyellowing |
| E1 | 52.7 |
| E2 | 53.2 |
| E3 | 52.1 |
| E4 | 53.9 |
| Control | 54.2 |

This series demonstrates the nonyellowing of the cloths treated with an emulsion based on silicone oils according to the invention; indeed, the whiteness value is close to that of an untreated cloth.

| Second series | | |
|---|---|---|
| Emulsion | Feel | Hydrophilicity |
| E1 | 3 | 6.5 |
| E2 | 6 | 7 |
| E3 | 10 | 8.5 |
| E5 | 7 | 9.7 |
| E6 | 11 | 15.8 |
| E7 | 12 | 17.9 |

This series demonstrates the hydrophilic and softening properties of the oils according to the invention.

| Third series | | |
|---|---|---|
| Emulsion | Feel | Hydrophilicity |
| E1 | 1 | 6.1 |
| E3 | 6 | 7.4 |

-continued

| Third series | | |
|---|---|---|
| Emulsion | Feel | Hydrophilicity |
| E4 | 4 | 8.5 |
| E7 | 8 | 18.5 |

This series, as the preceding one, demonstrates the hydrophilic and softening properties of the oils according to the invention.

The invention claimed is:

1. A method for treating a textile material in order to provide the textile material with a soft feel, absence of yellowing and good hydrophilicity, the method comprising contacting the textile material, with an aqueous emulsion comprising water, a surfactant and at least one linear, cyclic or three-dimensional polyorganosiloxane of formula (I):

(I)

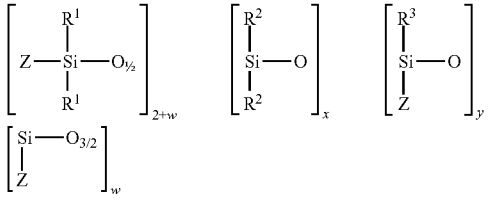

in which:

(1) the symbols Z, which are identical or different, represent $R^1$, and/or V;

(2) the symbols $R^1$, $R^2$ and $R^3$, which are identical and/or different, represent a monovalent hydrocarbon radical selected from linear or branched alkyl radicals having from 1 to 4 carbon atoms, linear or branched alkoxy radicals having from 1 to 4 carbon atoms, a phenyl radical and, preferably, a hydroxyl radical, an ethoxy radical, a methoxy radical or a methyl radical;

(3) the symbols V, functional groups which are identical and/or different, represent a group containing a sterically hindered piperidinyl functional group or groups selected from:

(II)

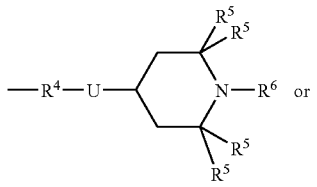

(III)

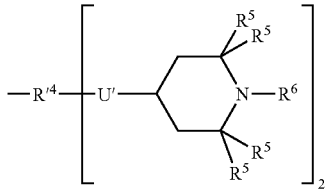

for the groups of formula (II):

(II)

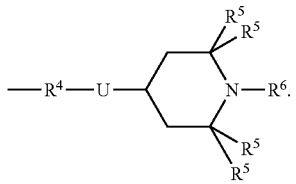

$R^4$ is a divalent hydrocarbon radical selected from:

linear or branched alkylene radicals having 2 to 18 carbon atoms;

alkylene-carbonyl radicals in which the linear or branched alkylene portion contains 2 to 20 carbon atoms;

alkylene-cyclohexylene radicals in which the linear or branched alkylene portion contains 2 to 12 carbon atoms and the cyclohexylene portion contains an OH group and optionally 1 or 2 alkyl radicals having 1 to 4 carbon atoms;

radicals of formula —$R^7$—O—$R^7$ in which the radicals $R^7$, which are identical or different, represent alkylene radicals having 1 to 12 carbon atoms;

radicals of formula —$R^7$—O—$R^7$ in which the radicals $R^7$ have the meanings indicated above and one of them or both of them are substituted by one or two —OH group or groups;

radicals of formula —$R^7$—COO—$R^7$ in which the radicals $R^7$ have the meanings indicated above;

radicals of formula —$R^8$—O—$R^9$—O—CO—$R^8$ in which the radicals $R^8$ and $R^9$, which are identical or different, represent alkylene radicals having 2 to 12 carbon atoms and the radical $R^9$ is optionally substituted by a hydroxyl radical;

U represents —O— or —$NR^{10}$—, $R^{10}$ being a radical selected from a hydrogen atom, a linear or branched alkyl radical containing 1 to 6 carbon atoms and a divalent radical of formula:

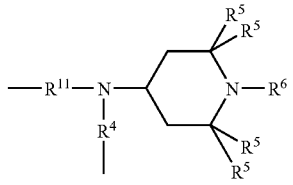

in which:

$R^4$ has the meaning indicated above, $R^5$ and $R^6$ have the meanings indicated below and $R^{11}$ represents a linear or branched divalent alkylene radical having from 1 to 12 carbon atoms, one of the valency bonds (that of $R^{11}$) being linked to the atom of —$NR^{10}$—, the other (that of $R^4$) being linked to a silicon atom;

the radicals $R^5$, which are identical or different, are selected from linear or branched alkyl radicals having 1 to 3 carbon atoms and the phenyl radical;

the radical $R^6$ represents a hydrogen radical or the radical $R^5$ or O;

for the groups of formula (III):

(III)

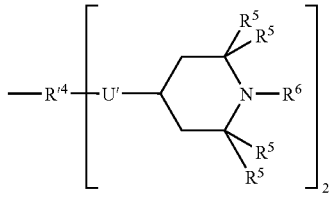

$R'^4$ is selected from a trivalent radical of formula:

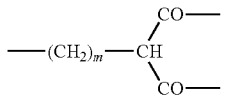

where m represents a number from 2 to 20, and a trivalent radical of formula:

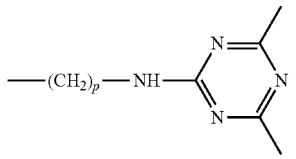

where p represents a number from 2 to 20;

U' represents —O— or $NR^{12}$—, with $R^{12}$ being a radical selected from a hydrogen atom, a linear or branched alkyl radical containing 1 to 6 carbon atoms;

$R^5$ and $R^6$ have the same meanings as those given with respect to the formula (II); and (4) the number of units ηSi with no group ranges from 50 to 250, and the number of units ηSi with a group V ranges from 1 to 3 and $0 \leqq w \leqq 10$ and $8 \leqq y \leqq 448$.

2. The method as defined by claim 1, wherein the polyorganosiloxane of formula (I) is linear.

3. The method as defined by claim 1, wherein V is selected from the functional groups of formula (II).

4. The method as defined by claim 1, wherein the composition containing the polyorganosiloxane is in liquid form.

5. The method as defined by claim 1, wherein the textile material is a woven material, a knitted material or a nonwoven material, and the textile material is at least intrinsically hydrophilic.

6. The method as defined by claim 1, wherein the textile material treated is based on cotton, flax, wool, viscose, rayon, hemp, silk or a mixture of these materials.

7. The method as defined by claim 1, wherein the quantity of polyorganosiloxane deposited on the treated textile material corresponds to a quantity of from 0.1 to 2% by weight relative to the weight of the treated dry textile material.

8. A method for treating a textile material in order to provide the textile material with a soft feel, absence of yellowing and good hydrophilicity, the method comprising contacting the textile with a composition comprising at least one linear, cyclic or three-dimensional polyorganosiloxane of formula (I):

(I)

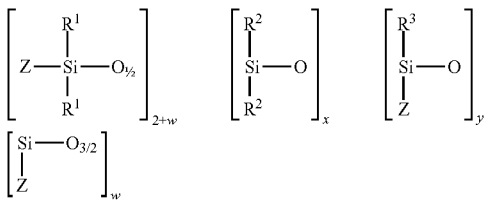

in which:

(1) the symbols Z, which are identical or different, represent $R^1$, and/or V;

(2) the symbols $R^1$, $R^2$ and $R^3$, which are identical and/or different, represent a monovalent hydrocarbon radical selected from linear or branched alkyl radicals having from 1 to 4 carbon atoms, linear or branched alkoxy radicals having from 1 to 4 carbon atoms, a phenyl radical and, preferably, a hydroxyl radical, an ethoxy radical, a methoxy radical or a methyl radical;

(3) the symbols V, functional groups which are identical and/or different, represent a group containing a sterically hindered piperidinyl functional group or groups selected from:

(II)

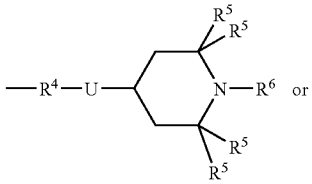

(III)

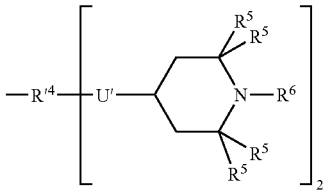

for the groups of formula (II):

(II)

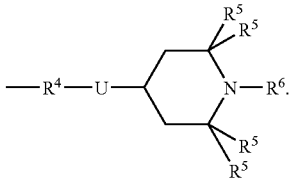

$R^4$ is a divalent hydrocarbon radical selected from:

linear or branched alkylene radicals having 2 to 18 carbon atoms;

alkylene-carbonyl radicals in which the linear or branched alkylene portion contains 2 to 20 carbon atoms;

alkylene-cyclohexylene radicals in which the linear or branched alkylene portion contains 2 to 12 carbon atoms and the cyclohexylene portion contains an OH group and optionally 1 or 2 alkyl radicals having 1 to 4 carbon atoms;

radicals of formula —$R^7$—O—$R^7$ in which the radicals $R^7$, which are identical or different, represent alkylene radicals having 1 to 12 carbon atoms;

radicals of formula —$R^7$—O—$R^7$ in which the radicals $R^7$ have the meanings indicated above and one of them or both of them are substituted by one or two —OH group or groups;

radicals of formula —$R^7$—COO—$R^7$ in which the radicals $R^7$ have the meanings indicated above;

radicals of formula —$R^8$—O—$R^9$—O—CO—$R^8$ in which the radicals $R^8$ and $R^9$, which are identical or different, represent alkylene radicals having 2 to 12 carbon atoms and the radical $R^9$ is optionally substituted by a hydroxyl radical;

U represents —O— or —$NR^{10}$—, $R^{10}$ a radical selected from a hydrogen atom, a linear or branched alkyl radical containing 1 to 6 carbon atoms and a divalent radical of formula:

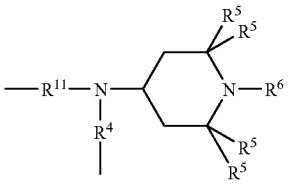

in which:

$R^4$ has the meaning indicated above, $R^5$ and $R^6$ have the meanings indicated below and $R^{11}$ represents a linear or branched divalent alkylene radical having from 1 to 12 carbon atoms, one of the valency bonds (that of $R^{11}$) being linked to the atom of —$NR^{10}$—, the other (that of $R^4$) being linked to a silicon atom;

the radicals $R^5$, which are identical or different, are selected from linear or branched alkyl radicals having 1 to 3 carbon atoms and the phenyl radical;

the radical $R^6$ represents a hydrogen radical or the radical $R^5$ or O;

for the groups of formula (III):

(III)

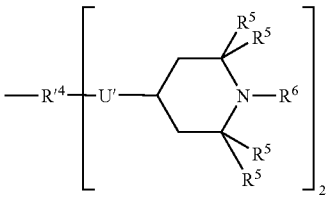

$R'^4$ is selected from a trivalent radical of formula:

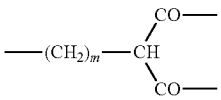

where m represents a number from 2 to 20, and a trivalent radical of formula:

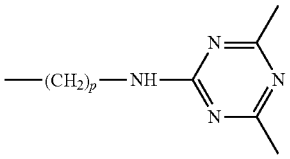

where p represents a number from 2 to 20;

U' represents —O— or $NR^{12}$—, with $R^{12}$ being a radical selected from a hydrogen atom, a linear or branched alkyl radical containing 1 to 6 carbon atoms;

$R^5$ and $R^6$ have the same meanings as those given with respect to the formula (II); and (4) the number of units ηSi with no group ranges from 50 to 250, and the number of units ηSi with a group V ranges from 1 to 3 and $0 \leqq w \leqq 10$ and $8 \leqq y \leqq 448$, wherein the composition comprising formula (I) is a silicone oil emulsion comprising the structure:

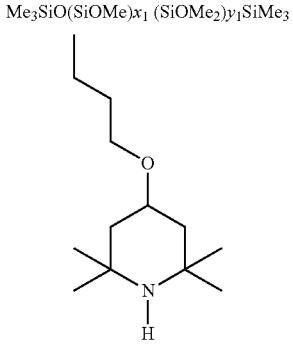

wherein:

$x_1=100$ and $y_1=1$.

9. A method for treating a textile material in order to provide the textile material with a soft feel, absence of yellowing and good hydrophilicity, the method comprising contacting the textile with a composition comprising at least one linear, cyclic or three-dimensional polyorganosiloxane of formula (I):

(I)

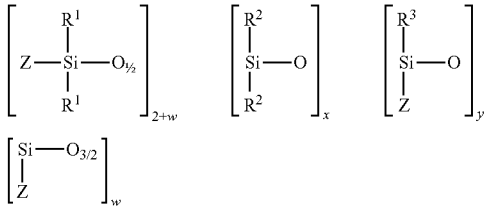

in which:

(1) the symbols Z, which are identical or different, represent $R^1$, and/or V;

(2) the symbols $R^1$, $R^2$ and $R^3$, which are identical and/or different, represent a monovalent hydrocarbon radical selected from linear or branched alkyl radicals having from 1 to 4 carbon atoms, linear or branched alkoxy radicals having from 1 to 4 carbon atoms, a phenyl radical and, preferably, a hydroxyl radical, an ethoxy radical, a methoxy radical or a methyl radical;

(3) the symbols V, functional groups which are identical and/or different, represent a group containing a sterically hindered piperidinyl functional group or groups selected from:

(II)

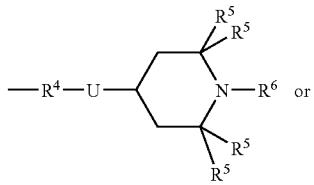

-continued (III)

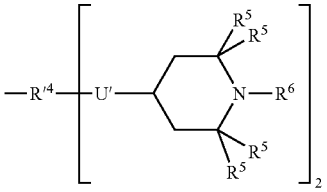

for the groups of formula (II):

(II)

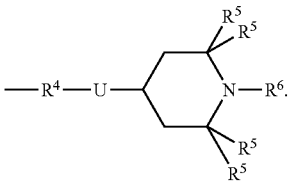

$R^4$ is a divalent hydrocarbon radical selected from:

linear or branched alkylene radicals having 2 to 18 carbon atoms;

alkylene-carbonyl radicals in which the linear or branched alkylene portion contains 2 to 20 carbon atoms;

alkylene-cyclohexylene radicals in which the linear or branched alkylene portion contains 2 to 12 carbon atoms and the cyclohexylene portion contains an OH group and optionally 1 or 2 alkyl radicals having 1 to 4 carbon atoms;

radicals of formula —$R^7$—O—$R^7$ in which the radicals $R^7$, which are identical or different, represent alkylene radicals having 1 to 12 carbon atoms;

radicals of formula —$R^7$—O—$R^7$ in which the radicals $R^7$ have the meanings indicated above and one of them or both of them are substituted by one or two —OH group or groups;

radicals of formula —$R^7$—COO—$R^7$ in which the radicals $R^7$ have the meanings indicated above;

radicals of formula —$R^8$—O—$R^9$—O—CO—$R^8$ in which the radicals $R^8$ and $R^9$, which are identical or different, represent alkylene radicals having 2 to 12 carbon atoms and the radical $R^9$ is optionally substituted by a hydroxyl radical;

U represents —O— or —$NR^{10}$—, $R^{10}$ being a radical selected from a hydrogen atom, a linear or branched alkyl radical containing 1 to 6 carbon atoms and a divalent radical of formula:

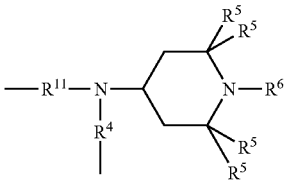

in which:

$R^4$ has the meaning indicated above, $R^5$ and $R^6$ have the meanings indicated below and $R^{11}$ represents a linear or branched divalent alkylene radical having from 1 to 12 carbon atoms, one of the valency bonds (that of $R^{11}$) being linked to the atom of —$NR^{10}$—, the other (that of $R^4$) being linked to a silicon atom;

the radicals $R^5$, which are identical or different, are selected from linear or branched alkyl radicals having 1 to 3 carbon atoms and the phenyl radical;

the radical $R^6$ represents a hydrogen radical or the radical $R^5$ or O;

for the groups of formula (III):

(III)

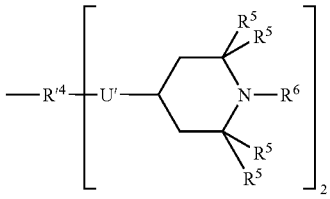

$R'^4$ is selected from a trivalent radical of formula:

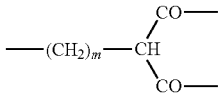

where m represents a number from 2 to 20, and a trivalent radical of formula:

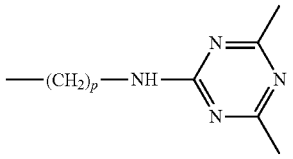

where p represents a number from 2 to 20;

U' represents —O— or $NR^{12}$—, with $R^{12}$ being a radical selected from a hydrogen atom, a linear or branched alkyl radical containing 1 to 6 carbon atoms;

$R^5$ and $R^6$ have the same meanings as those given with respect to the formula (II);

and (4) the number of units ηSi with no group ranges from 50 to 250, and the number of units ηSi with a group V ranges from 1 to 3 and $0 \leqq w \leqq 10$ and $8 \leqq y \leqq 448$, wherein the composition comprising formula (I) is a silicone oil emulsion comprising the structure:

$Me_3SiO(SiOMe)x_1\ (SiOMe_2)y_1SiMe_3$

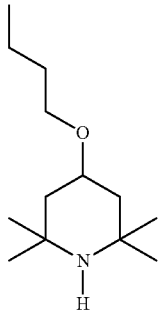

wherein:

$x_1$=100 and $y_1$=2.

10. A method for treating a textile material in order to provide the textile material with a soft feel, absence of yellowing and good hydrophilicity, the method comprising contacting the textile with a composition comprising at least one linear, cyclic or three-dimensional polyorganosiloxane of formula (I):

(I)

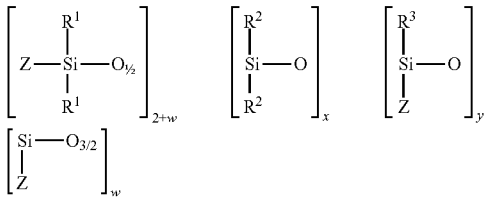

in which:

(1) the symbols Z, which are identical or different, represent $R^1$, and/or V;

(2) the symbols $R^1$, $R^2$ and $R^3$, which are identical and/or different, represent a monovalent hydrocarbon radical selected from linear or branched alkyl radicals having from 1 to 4 carbon atoms, linear or branched alkoxy radicals having from 1 to 4 carbon atoms, a phenyl radical and, preferably, a hydroxyl radical, an ethoxy radical, a methoxy radical or a methyl radical;

(3) the symbols V, functional groups which are identical and/or different, represent a group containing a sterically hindered piperidinyl functional group or groups selected from:

(II)

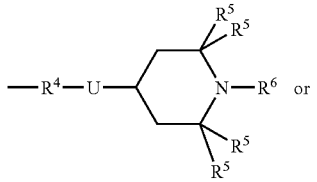

(III)

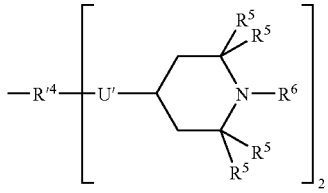

for the groups of formula (II):

(II)

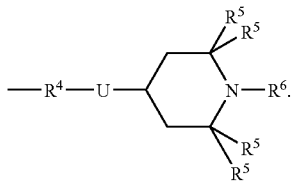

$R^4$ is a divalent hydrocarbon radical selected from:

linear or branched alkylene radicals having 2 to 18 carbon atoms;

alkylene-carbonyl radicals in which the linear or branched alkylene portion contains 2 to 20 carbon atoms;

alkylene-cyclohexylene radicals in which the linear or branched alkylene portion contains 2 to 12 carbon atoms and the cyclohexylene portion contains an OH group and optionally 1 or 2 alkyl radicals having 1 to 4 carbon atoms;

radicals of formula —$R^7$—O—$R^7$ in which the radicals $R^7$, which are identical or different, represent alkylene radicals having 1 to 12 carbon atoms;

radicals of formula —$R^7$—O—$R^7$ in which the radicals $R^7$ have the meanings indicated above and one of them or both of them are substituted by one or two —OH group or groups;

radicals of formula —$R^7$—COO—$R^7$ in which the radicals $R^7$ have the meanings indicated above;

radicals of formula —$R^8$—O—$R^9$—O—CO—$R^8$ in which the radicals $R^8$ and $R^9$, which are identical or different, represent alkylene radicals having 2 to 12 carbon atoms and the radical $R^9$ is optionally substituted by a hydroxyl radical;

U represents —O— or —$NR^{10}$—, $R^{10}$ being a radical selected from a hydrogen atom, a linear or branched alkyl radical containing 1 to 6 carbon atoms and a divalent radical of formula:

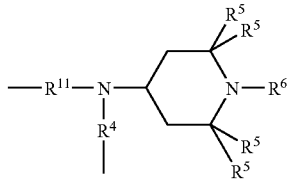

in which:

$R^4$ has the meaning indicated above, $R^5$ and $R^6$ have the meanings indicated below and $R^{11}$ represents a linear or branched divalent alkylene radical having from 1 to 12 carbon atoms, one of the valency bonds (that of $R^{11}$) being linked to the atom of —$NR^{10}$—, the other (that of $R^4$) being linked to a silicon atom;

the radicals $R^5$, which are identical or different, are selected from linear or branched alkyl radicals having 1 to 3 carbon atoms and the phenyl radical;

the radical $R^6$ represents a hydrogen radical or the radical $R^5$ or O;

for the groups of formula (III):

(III)

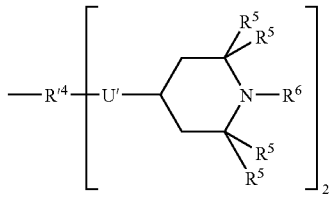

$R'^4$ is selected from a trivalent radical of formula:

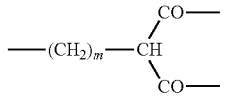

where m represents a number from 2 to 20, and a trivalent radical of formula:

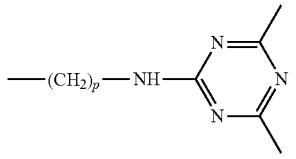

where p represents a number from 2 to 20;

U' represents —O— or $NR^{12}$—, with $R^{12}$ being a radical selected from a hydrogen atom, a linear or branched alkyl radical containing 1 to 6 carbon atoms;

$R^5$ and $R^6$ have the same meanings as those given with respect to the formula (II); and (4) the number of units ηSi with no group ranges from 50 to 250, and the number of units ηSi with a group V ranges from 1 to 3 and $0 \leqq w \leqq 10$ and $8 \leqq y \leqq 448$, wherein the composition comprising formula (I) is a silicone oil emulsion comprising the structure:

$Me_3SiO(SiOMe)x_1(SiOMe_2)y_1SiMe_3$

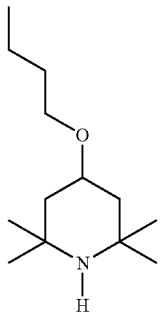

wherein:

$x_1$=250 and $y_1$=2.5.

11. A method for treating a textile in order to provide the textile material with a soft feel, absence of yellowing and good hydrophilicity material the method consisting essentially of contacting the textile material, with an aqueous emulsion consisting of water, a surfactant and at least one linear, cyclic or three-dimensional polyorganosiloxane of formula (I):

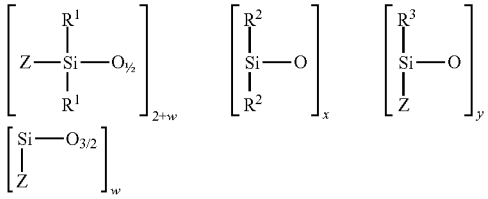

(I)

in which:

(1) the symbols Z, which are identical or different, represent $R^1$, and/or V;

(2) the symbols $R^1$, $R^2$ and $R^3$, which are identical and/or different, represent a monovalent hydrocarbon radical selected from linear or branched alkyl radicals having from 1 to 4 carbon atoms, linear or branched alkoxy radicals having from 1 to 4 carbon atoms, a phenyl radical and, preferably, a hydroxyl radical, an ethoxy radical, a methoxy radical or a methyl radical;

(3) the symbols V, functional groups which are identical and/or different, represent a group containing a sterically hindered piperidinyl functional group or groups selected from:

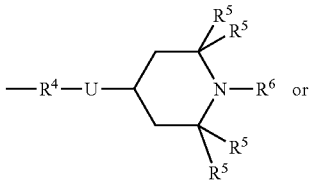

(II)

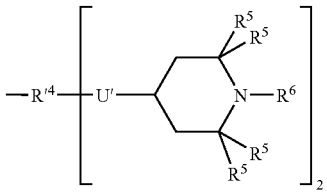

(III)

for the groups of formula (II):

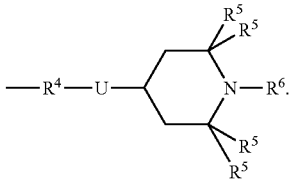

(II)

$R^4$ is a divalent hydrocarbon radical selected from:

linear or branched alkylene radicals having 2 to 18 carbon atoms;

alkylene-carbonyl radicals in which the linear or branched alkylene portion contains 2 to 20 carbon atoms;

alkylene-cyclohexylene radicals in which the linear or branched alkylene portion contains 2 to 12 carbon atoms and the cyclohexylene portion contains an OH group and optionally 1 or 2 alkyl radicals having 1 to 4 carbon atoms;

radicals of formula —$R^7$—O—$R^7$ in which the radicals $R^7$, which are identical or different, represent alkylene radicals having 1 to 12 carbon atoms;

radicals of formula —$R^7$—O—$R^7$ in which the radicals $R^7$ have the meanings indicated above and one of them or both of them are substituted by one or two —OH group or groups;

radicals of formula —$R^7$—COO—$R^7$ in which the radicals $R^7$ have the meanings indicated above;

radicals of formula —$R^8$—O—$R^9$—O—CO—$R^8$ in which the radicals $R^8$ and $R^9$, which are identical or different, represent alkylene radicals having 2 to 12 carbon atoms and the radical $R^9$ is optionally substituted by a hydroxyl radical;

U represents —O— or —$NR^{10}$—, $R^{10}$ being a radical selected from a hydrogen atom, a linear or branched alkyl radical containing 1 to 6 carbon atoms and a divalent radical of formula:

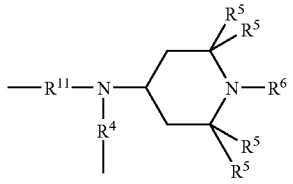

in which:

$R^4$ has the meaning indicated above, $R^5$ and $R^6$ have the meanings indicated below and $R^{11}$ represents a linear or branched divalent alkylene radical having from 1 to 12 carbon atoms, one of the valency bonds (that of $R^{11}$) being linked to the atom of —$NR^{10}$—, the other (that of $R^4$) being linked to a silicon atom;

the radicals $R^5$, which are identical or different, are selected from linear or branched alkyl radicals having 1 to 3 carbon atoms and the phenyl radical;

the radical $R^6$ represents a hydrogen radical or the radical $R^5$ or O;

for the groups of formula (III):

(III)

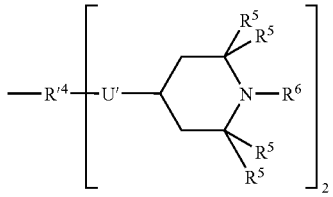

$R'^4$ is selected from a trivalent radical of formula:

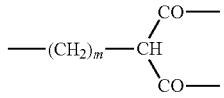

where m represents a number from 2 to 20, and a trivalent radical of formula:

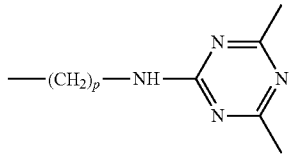

where p represents a number from 2 to 20;

U' represents —O— or $NR^{12}$—, with $R^{12}$ being a radical selected from a hydrogen atom, a linear or branched alkyl radical containing 1 to 6 carbon atoms;

$R^5$ and $R^6$ have the same meanings as those given with respect to the formula (II); and (4) the number of units ηSi with no group ranges from 50 to 250, and the number of units ηSi with a group V ranges from 1 to 3 and $0 \leqq w \leqq 10$ and $8 \leqq y \leqq 448$.

* * * * *